US009868029B2

(12) United States Patent
Kern et al.

(10) Patent No.: US 9,868,029 B2
(45) Date of Patent: Jan. 16, 2018

(54) APPARATUS, IN PARTICULAR FOR BALANCE TRAINING, HAVING AT LEAST ONE MOVABLE PLATFORM

(71) Applicant: Astrium GmbH, Taufkirchen (DE)

(72) Inventors: Peter Kern, Salem (DE); Ulrich Kuebler, Markdorf (DE); Matthias Simnacher, Markdorf (DE); Marcos Esteller Vela, Tervel (ES)

(73) Assignee: Airbus DS GmbH, Taufkirchen (DE)

( * ) Notice: Subject to any disclaimer, the term of this patent is extended or adjusted under 35 U.S.C. 154(b) by 0 days.

(21) Appl. No.: 14/220,660

(22) Filed: Mar. 20, 2014

(65) Prior Publication Data

US 2014/0287896 A1 Sep. 25, 2014

(30) Foreign Application Priority Data

Mar. 21, 2013 (EP) ..... 13160478

(51) Int. Cl.
*A63B 21/015* (2006.01)
*A63B 26/00* (2006.01)
(Continued)

(52) U.S. Cl.
CPC ..... *A63B 26/003* (2013.01); *A63B 22/18* (2013.01); *A63B 24/0087* (2013.01);
(Continued)

(58) Field of Classification Search
CPC .. A63B 1/00; A63B 1/005; A63B 3/00; A63B 23/1209; A63B 23/1218; A63B 26/003; A63B 22/0015; A63B 22/0046; A63B 22/0087; A63B 22/14; A63B 22/16; A63B 22/18; A63B 22/20; A63B 22/201;
(Continued)

(56) References Cited

U.S. PATENT DOCUMENTS 3,761,084 A 9/1973 Dieckmann
4,509,743 A * 4/1985 Lie ..... 482/71
(Continued)

FOREIGN PATENT DOCUMENTS

DE 20 2010 004545 U1 8/2010
DE 20 2012 005 792 U1 8/2012
(Continued)

OTHER PUBLICATIONS

European Search Report dated Sep. 4, 2013 issued in corresponding EP patent application No. 13160478.7 (and partial English translation).
(Continued)

*Primary Examiner* — Nyca T Nguyen
(74) *Attorney, Agent, or Firm* — Posz Law Group, PLC

(57) ABSTRACT

An apparatus for balance training and/or fine motor skills training, having at least one movable platform which can be moved in an oscillating manner in at least two dimensions, having at least one counterforce unit which is provided to oppose a force for producing a deflection of the movable platform with a resistance. The apparatus has at least one force transmission interruption unit which interrupts a force flow between the movable platform and the counterforce unit in at least one operating state.

20 Claims, 4 Drawing Sheets

Figure 1:
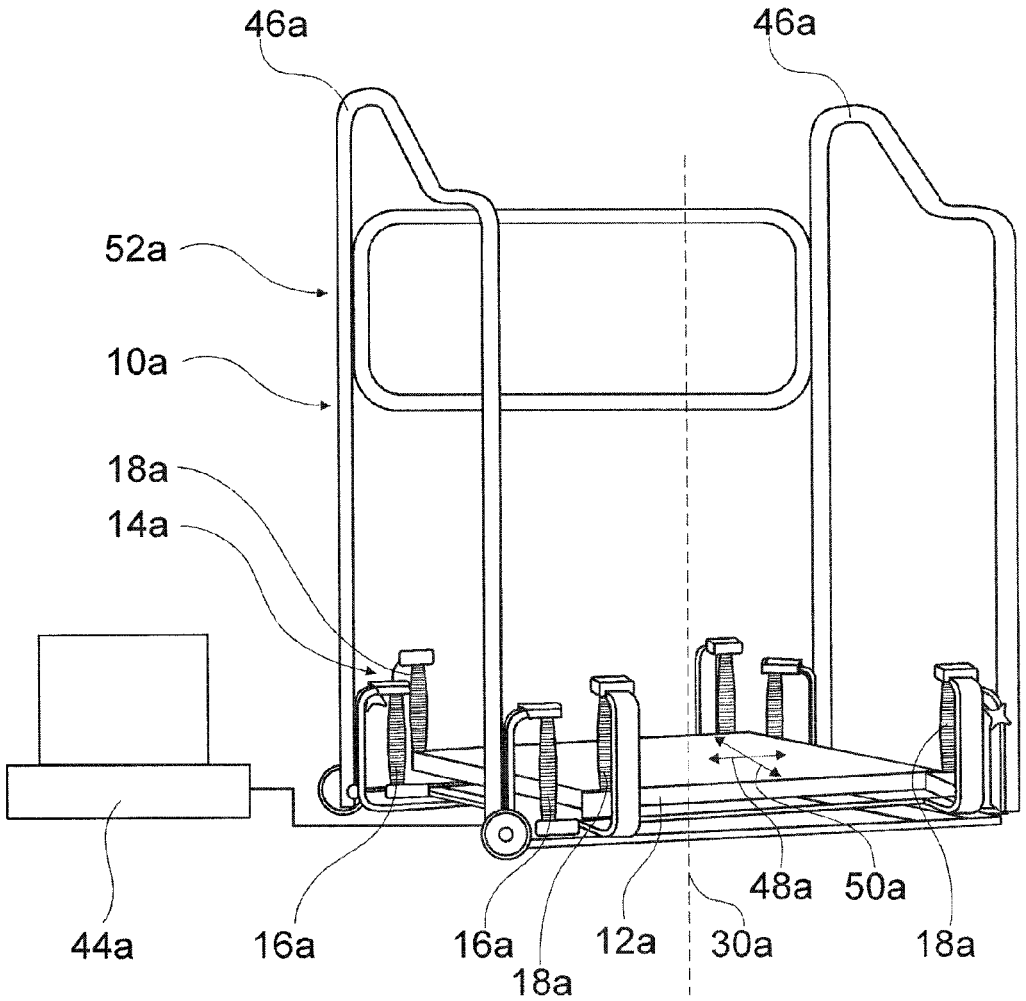

(51) Int. Cl.

| | |
|---|---|
| ***A63B 22/14*** | (2006.01) |
| ***A63B 71/06*** | (2006.01) |
| ***A63B 22/18*** | (2006.01) |
| ***A63B 24/00*** | (2006.01) |
| *A63B 71/00* | (2006.01) |
| *A63B 21/005* | (2006.01) |
| *A63B 21/012* | (2006.01) |
| *A63B 21/02* | (2006.01) |
| *A63B 21/04* | (2006.01) |
| *A63B 21/055* | (2006.01) |
| *A63B 21/00* | (2006.01) |

(52) U.S. Cl.
CPC ..... *A63B 71/0622* (2013.01); *A63B 21/0051* (2013.01); *A63B 21/0056* (2013.01); *A63B 21/00196* (2013.01); *A63B 21/012* (2013.01); *A63B 21/023* (2013.01); *A63B 21/0442* (2013.01); *A63B 21/0552* (2013.01); *A63B 2024/0093* (2013.01); *A63B 2071/0072* (2013.01); *A63B 2071/0652* (2013.01); *A63B 2071/0683* (2013.01); *A63B 2220/18* (2013.01); *A63B 2220/34* (2013.01); *A63B 2220/44* (2013.01); *A63B 2220/806* (2013.01); *A63B 2220/89* (2013.01)

(58) Field of Classification Search
CPC ..... A63B 22/203; A63B 21/00007; A63B 21/00014; A63B 21/00004; A63B 21/023; A63B 21/026; A63B 21/04; A63B 21/0407; A63B 21/0428; A63B 21/055; A63B 21/05555; A63B 21/1488; A63B 21/151; A63B 21/153; A63B 22/0056; A63B 2022/185; A63B 2026/006
USPC ..... 73/379.01–379.05
See application file for complete search history.

(56) References Cited

U.S. PATENT DOCUMENTS

| | | | | |
|---|---|---|---|---|
| 5,429,562 | A * | 7/1995 | Milner | 482/51 |
| 5,582,567 | A * | 12/1996 | Chang | 482/146 |
| 5,667,462 | A | 9/1997 | Gordon | |
| 6,052,955 | A | 4/2000 | Haider | |
| 6,176,817 | B1 * | 1/2001 | Carey | A63B 22/18 482/146 |
| 6,217,488 | B1 * | 4/2001 | Bernardson | 482/79 |
| 6,500,097 | B1 * | 12/2002 | Hall | 482/54 |
| 6,958,032 | B1 * | 10/2005 | Smith et al. | 482/121 |
| 7,645,221 | B1 * | 1/2010 | Curry | 482/148 |
| 2006/0160669 | A1 * | 7/2006 | Lizarralde | A63B 21/0051 482/63 |
| 2008/0254958 | A1 * | 10/2008 | Ferrara | A61H 1/003 482/142 |
| 2009/0111670 | A1 * | 4/2009 | Williams | A63B 23/0464 482/146 |
| 2009/0312165 | A1 * | 12/2009 | Rempe | 482/146 |
| 2010/0210429 | A1 * | 8/2010 | Wang | 482/127 |
| 2011/0039669 | A1 | 2/2011 | Stewart et al. | |
| 2011/0195827 | A1 * | 8/2011 | Piane, Jr. | A63B 7/00 482/142 |
| 2011/0256983 | A1 * | 10/2011 | Malack | A61H 1/0266 482/4 |
| 2013/0045812 | A1 * | 2/2013 | Garner | 472/97 |

FOREIGN PATENT DOCUMENTS

| | | | |
|---|---|---|---|
| EP | 0 810 834 | B1 | 9/1999 |
| GB | 1 372 342 | A | 10/1974 |
| JP | 2001-327626 | A | 11/2001 |
| JP | 2006-167094 | A | 6/2006 |

OTHER PUBLICATIONS

Office Action dated Sep. 29, 2015 in the corresponding JP application No. 2014-058877 (with English translation).

Japanese Office Action dated Jul. 19, 2016 in the corresponding Japanese application No. 2014-058877. (English translation attached).

Office Action dated Mar. 17, 2016 issued in corresponding EP patent application No. 13 160 478.1 (and partial English translation).

* cited by examiner

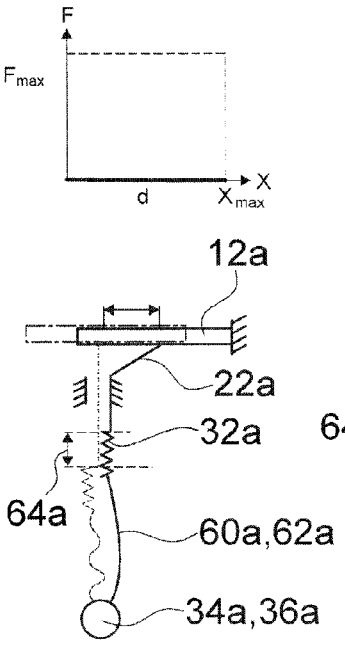
Fig. 3-A
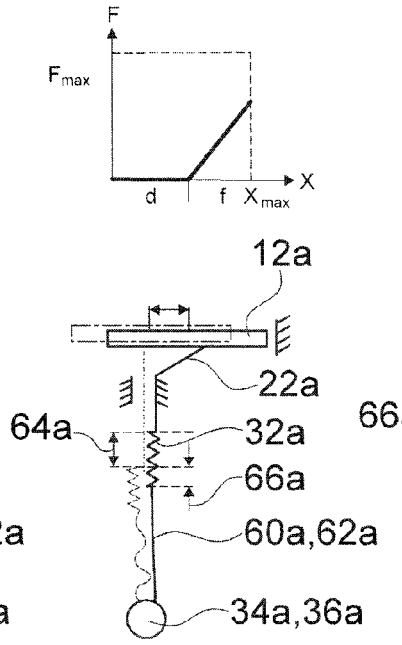
Fig. 3-B
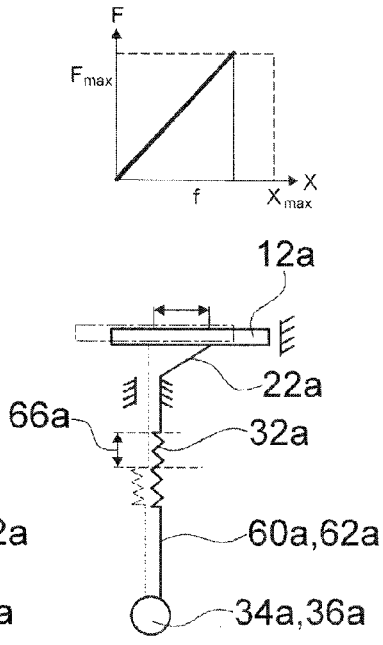
Fig. 3-C
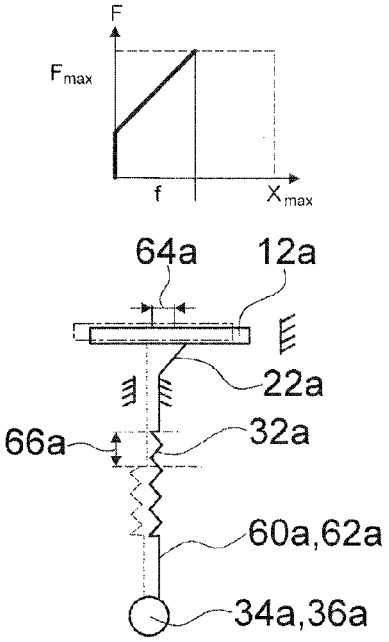
Fig. 3-D
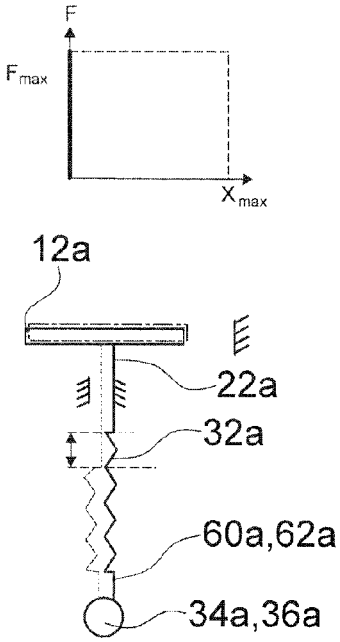
Fig. 3-E

APPARATUS, IN PARTICULAR FOR BALANCE TRAINING, HAVING AT LEAST ONE MOVABLE PLATFORM

CROSS REFERENCE TO RELATED APPLICATION

This application is based on and incorporates herein by reference European Patent Application No. 13160478.7 filed on Mar. 21, 2013.

PRIOR ART

The invention relates to an apparatus in accordance with the precharacterizing clause of claim 1.

Apparatuses for balance training and/or fine motor skills training have at least one movable platform which can be moved in at least two dimensions in a rocking manner. Apparatuses are known with damping elements for damping movements of the movable platform, which damping elements are configured, for example, as plastic-encapsulated steel cables which fasten the platform in a hanging manner and have a damping effect on account of material properties of the plastic encapsulation. The known damping elements can be set merely very roughly and a dynamic change or adaptation of damping properties during operation of the apparatus is not possible.

It is the objective of the invention, in particular, to provide an apparatus of the generic type with improved properties with regard to adaptability of a damping action. According to the invention, the objective is achieved by way of the features of patent claim 1, whereas advantageous refinements and developments of the invention can be gathered from the subclaims.

ADVANTAGES OF THE INVENTION

The invention proceeds from an apparatus, in particular an apparatus for balance training and/or fine motor skills training, having at least one movable platform which can be moved in an oscillating manner in at least two dimensions, and having at least one counterforce unit which is provided to oppose a force for producing a deflection of the movable platform with a resistance. A "movable platform which can be moved in an oscillating manner in at least two dimensions" is to be understood to mean, in particular, a platform, preferably a flat platform, which is mounted in such a way, for example by means of suspension on a framework, that it can be deflected within a predefined deflection region at least along two directions in one plane which run perpendicularly with respect to one another, preferably a plane parallel with respect to a floor, on which the apparatus is set up, and which has a restoring means of the deflection to a rest position. In particular, in addition to the deflection in two directions in the plane, the movable platform can also be tilted in a direction perpendicular with respect to the plane or the movable platform can be deflected three-dimensionally by a rolling and tilting angle without a translational movement. The platform has a standing surface, on which a person stands who deflects the platform on account of his/her own movements and/or counteracts a deflection of the platform as a result of an external stimulus. The standing surface is preferably of flat configuration, but the standing surface can in principle also be configured to be curved or in other basic shapes which are different from a flat surface, for example hemispherical. The apparatus is provided, in particular, for use for training in order to reinforce the sense of balance or for a therapy for disruptions of the sense of balance. A "counterforce unit which opposes a force for deflection of the movable platform with a resistance" is to be understood to mean, in particular, a unit which is provided to oppose a force which leads to a deflection of the platform with a counterforce and thus to oppose a deflection of the platform with a defined resistance. To this end, the counterforce unit comprises, in particular, elastic elements which generate a restoring force, such as spring elements.

It is proposed that the apparatus has at least one force transmission interruption unit which, in at least one operating state, interrupts a force flow between the movable platform and the counterforce unit. A "force transmission interruption unit" is to be understood to mean, in particular, a unit which is provided to interrupt a force flow between the movable platform and the counterforce unit in at least one operating state, by the force flow being converted in the force transmission interruption unit in the at least one operating state into an action of force on the force transmission interruption unit, for example into stressing of a previously slack cable element or into an at least largely resistance-free extension of a piston as far as a stop. In particular, an operating mode of the apparatus can be realized by way of the force transmission interruption unit, in which operating mode a deflection of the movable platform from the rest position takes place substantially free of a counterforce within a provided initial region and, when the provided initial region is exceeded, the deflection of the movable platform is opposed by a counterforce by way of the counterforce unit, "Substantially free of a counterforce" is to be understood to mean, in particular, that an active counterforce provided for deflection of the movable platform is at most ten percent, preferably at most five percent and particularly preferably at most one percent of a counterforce by way of the counterforce unit. An operating mode can be achieved, in particular, in which no counterforce is generated in a part region of a deflection and a counterforce is generated in further part regions, in order to generate a high training effect by way of a high variability of the counterforce.

Furthermore, it is proposed that the counterforce unit has at least one central connecting element which runs at least partially along a zero axis of a rest position of the at least one platform for connecting the at least one platform to the at least one counterforce unit and for transmitting an at least two-dimensional movement of the at least one platform. A "zero axis of a rest position of the platform" is to be understood to mean, in particular, an axis which lies perpendicularly on a plane of the at least one platform and runs through a geometric center of the at least one platform in a rest position of the at least one platform. A "connecting element" is to be understood to mean, in particular, an element which is provided to transmit a deflection of the at least one platform from the rest position to at least one further element. The connecting element is preferably configured as a flexurally slack element. A "central connecting element" is to be understood to mean, in particular, that the connecting element is arranged at least in a region close to the zero axis of the rest position of the platform, is preferably fastened to a center point of a surface of the platform, and that the connecting element converts deflections of equal magnitude of the platform in directions which are opposite one another into an identical deflection. In particular, damping of movements of the platform can take place via the central connecting element by way of damping of a movement of the central connecting element. "Damping of movements" is to be understood to mean, in particular, that the movements are opposed by a counterforce, in particular a restoring force, with the result that a deflection of the platform which is achieved by an acting, deflecting force is smaller than a deflection as a result of the acting, deflecting force which can act in a manner which is free from damping. In particular, the central connecting element is provided to transmit the at least two-dimensional movement to the counterforce unit in a one-dimensional manner. In particular, a reduction in a number of required counterforce elements to generate a provided for deflections of the platform can be achieved.

Furthermore, it is proposed that the at least one force transmission interruption unit comprises at least one connecting element which, in the at least one operating state, is mounted at least partially in a stress-relieved state. The connecting element of the force transmission interruption unit is preferably formed by a cable element. A "stress-relieved state" is to be understood to mean, in particular, a state, in which the connecting element is tautened in the case of an action of force by way of a tensile force, for example by a cable element which lies in loops and/or lies slackly on a floor being stressed into a straight state and/or being raised up, or by a piston being extended as far as a stop. In the operating state, in particular, the connecting element which is mounted in the stress-relieved state is first of all tautened by way of a deflection of the platform, and the force flow is guided to the counterforce unit only after complete tautening. In particular, a counterforce unit can be achieved in a structurally simple manner.

Furthermore, it is proposed that the at least one central connecting element transmits the at least two-dimensional movement of the at least one platform to the at least one counterforce unit in a one-dimensional manner. In particular, a reduction in a required number of counterforce elements of the counterforce unit can be achieved.

Furthermore, it is proposed that the at least one counterforce unit has at least one movement conversion unit which converts a rotational component of the at least two-dimensional movement of the at least one platform into a rotational movement of the at least one central connecting element about an axis of its own. In particular, an amount of a translational deflection of the platform from the rest position remains as a deflection of the central connecting element. In particular, the rotational component of the movement of the platform is converted into a rotational component of a movement of the at least one central connecting element in a part region of the central connecting element, which part region is arranged between the at least one movable platform and the at least one movement conversion unit, and said rotational component of the movement of the central connecting element is converted into a rotational movement of the central connecting element about the axis of its own. In particular, the at least two-dimensional movement of the platform is therefore converted into a one-dimensional movement of the central connecting element. A "movement conversion unit" is to be understood to mean, in particular, a unit which is provided for converting a movement in a rotational or translational direction into a movement in another rotational or translational direction. The movement conversion unit is preferably provided to reduce a dimensionality of a movement, by, for example, a two-dimensional movement with a rotational component being converted into a purely translational movement in one dimension. The movement conversion unit preferably comprises an element, about which the central connecting element can rotate, in order to convert the rotational component of the movement into a rotation about the axis of the central connecting element. In particular, a reduction in a number of required damping elements can be achieved, by only a translational deflection of the platform from the rest position still having to be opposed with a resistance.

Furthermore, it is proposed that the at least one movement conversion unit has at least one sleeve or at least one bore with a rounded opening. In particular, the sleeve or bore with a rounded opening is provided to convert a rotational component of a movement of the central connecting element into a rotation about the axis of its own of the central connecting element, by the central connecting element rotating about a contact point with the sleeve or bore at the rounded opening. In alternative refinements, in principle, the opening can be formed by a sharp-edged opening instead of a rounded opening. In particular, a structurally simple movement conversion unit can be achieved.

The at least one central connecting element is preferably formed at least partially by a cable element. A "cable element" is to be understood to mean, in particular, a flexurally slack elongate element which consists of natural or artificial fibers or of metallic wires, the fibers or wires being twisted, which element is provided for a transmission of tensile forces. In particular, the cable element is formed from a steel cable comprising steel wires. In particular, a cable element can have a coating, a sleeve or an encapsulation made from an identical or different material than a material of the fibers or wires. In principle, the central connecting element can be formed at least partially by a chain element. In particular, a central connecting element which can be produced simply and is inexpensive can be achieved.

Furthermore, it is proposed that the at least one counterforce unit has at least one spring element. A "spring element" is intended to mean, in particular, a macroscopic element which, in a normal operating state, can be changed elastically in at least one length by at least 10%, in particular by at least 20%, preferably by at least 30% and particularly advantageously by at least 50%, and which generates in particular a counterforce which counteracts the change and is dependent on a change in the length and is preferably proportional to the change. A "length" of an element is to be understood to mean, in particular, a maximum spacing of two points of a perpendicular projection of the element onto a plane. A "macroscopic element" is to be understood to mean, in particular, an element having an extent of at least 1 mm, in particular of at least 5 mm, preferably of at least 10 mm and particularly preferably of at least 50 mm. In particular, the spring element is connected to the central connecting element and opposes a deflection of the central connecting element with resistance which is dependent on a prestress, with the result that deflections in one direction are opposed by a resistance. The spring element can be configured as a linearly elastically deformable element or as a torsion spring element. A force/path behavior of the spring element can in principle be configured to be linear or nonlinear. In principle, instead of or in addition to a spring element, the counterforce unit can comprise an additional damping element which can be arranged in series with or parallel to the spring element in the counterforce unit. It is also conceivable in principle to use a number of groups of spring elements and additional damping elements which are arranged parallel to one another, the number of groups being connected in parallel and/or series to one another. The additional damping element can be formed by an element having internal damping properties, for example a rubber cable or a braided rubber cable with a non-linear load characteristic. The additional damping element can be of integrated configuration with the spring element. In particular, a counterforce unit which is configured in a structurally simple manner can be achieved.

The apparatus preferably comprises proposed at least one untwisting unit with respect to a connection of the central connecting element and the spring element, which makes rotation of the central connecting element about the axis of its own possible. An "untwisting unit" is to be understood to mean, in particular, a unit which is fastened at one end to an element, in particular the central connecting element, and makes a rotation of the element about the axis of its own within the element possible, the rotation of the element being converted into an internal rotation of the untwisting unit. In particular, a structurally simple connection of the central connecting element and the spring element can be achieved.

Furthermore, at least one setting unit which is provided for setting a counterforce strength is proposed. A "setting unit" is to be understood to mean, in particular, a unit which acts on the counterforce unit in a manner which is manual or is controlled in an electronic way, and changes a counterforce strength of the counterforce unit and therefore the possible movement radius of the platform in the case of a given deflection force. The setting unit is preferably provided to change the counterforce strength during operation of the apparatus. In particular, an apparatus which can be adapted in a flexible manner to different conditions can be achieved.

Furthermore, it is proposed that the at least one setting unit has at least one actuator, preferably at least one electric actuator. An "electric actuator" is to be understood to mean, in particular, a mechatronic component which is provided to convert electric signals into a movement, in particular into a linear or rotational movement. In particular, the electric actuator is provided to set a prestress of the spring element. In particular, the actuator is provided for infinitely variable setting of the prestress. In particular, an infinitely variable setting unit which can be realized inexpensively and can be actuated simply can be achieved.

As an alternative, the at least one counterforce unit can have at least one directly adjustable damping element. A "directly adjustable damping element" is to be understood to mean, in particular, a damping element, the counterforce strength of which can be set by means of a direct electric actuation, in particular without previous actuation of an actuator for adapting a prestressing force, or by application of an external electric and/or magnetic field. In alternative refinements, instead of or in addition to a directly adjustable damping element and/or spring element, the counterforce unit can also have an eddy current brake or a friction brake. In particular, infinitely variable and rapid setting of a counterforce strength can be achieved in a structurally simple manner. In particular, the directly adjustable damping element can be formed by an electrorheological damper and/or a magnetorheological damper. An "electrorheological damper" is to be understood to mean, in particular, a damper having an electrorheological liquid. An "electrorheological liquid" is to be understood to mean, in particular, a liquid in which electrically polarizable particles are suspended and which liquid has a viscosity which can be changed by application of an electric field as a result of the formation of dipoles in the particles. A "magnetorheological damper" is to be understood to mean, in particular, a damper having a magnetorheological liquid. A "magnetorheological liquid" is to be understood to mean, in particular, a liquid in which magnetic polarizable particles are suspended and which liquid has a viscosity which can be changed by application of a magnetic field. In particular, a structurally simple and directly adjustable damping element can be achieved.

Furthermore, it is proposed that the at least one setting unit has at least one control unit. A "control unit" is to be understood to mean, in particular, a unit which has at least one computing unit and at least one memory unit and which is provided to execute at least one program which is stored in the memory unit and preferably to perform setting of the counterforce strength depending on the stored program and/or on a movement of the platform. In particular, the control unit can be provided to set the counterforce strength depending on measured values of at least one sensor for measuring a deflection of the platform, deflection speed or deflection acceleration. The sensor can be formed, for example, by a camera, an induction sensor or a further sensor for positional measurement which appears to be suitable to a person skilled in the art. In particular, an apparatus which can be adapted in a flexible manner can be achieved. In particular, an apparatus can be achieved which can be adapted readily and rapidly to different requirement options and which, in particular, can be combined with further external devices, for example a videogame console.

In addition, the at least one control unit can be provided for executing a training program, in which a slow reduction in the counterforce strength of the counterforce unit as a result of an increase of a deflection amplitude of the platform is superimposed with a rapid increase in the counterforce strength. A "slow reduction" and a. "rapid increase" in the counterforce strength is to be understood to mean, in particular, that the reduction in the counterforce strength takes place slowly in comparison with the increase in the counterforce strength. An "increase of a deflection amplitude" is to be understood to mean, in particular, that an amplitude of deflections of the platform from the rest position increases on account of a diminishing of the counterforce strength, of an interruption of the force flow by the force transmission interruption unit which leads to a movement of the platform occurring largely free of a counterforce, and/or on account of movements of a person on the platform, for example compensating movements of the person in the case of an external stimulus. An increase of the deflection amplitude of the platform is preferably determined by the computing unit of the control unit. In particular, the rapid increase in the counterforce strength serves to avoid an excessively large increase of the deflection amplitude of the platform. In particular, the slow reduction of the counterforce strength is provided during the training program to challenge the person again and again during the training program as a result of a gradual increase in a deflection amplitude during an identical movement of the person on the platform, and therefore to achieve a high training effect. In particular, stability and motor capabilities of a person who passes through the training program can be determined and trained simply and reliably by way of a slow reduction of the counterforce strength and an increase, associated therewith, of a deflection of the platform, which deflection is brought about by movements of the person. In particular, a training program with a high stability which is adapted in a person-specific manner can be achieved. Furthermore, the central connecting element can be provided for damping the movement of the platform by means of external friction. "External friction" is to be understood to mean, in particular, a friction of the central connecting element with a further component of the apparatus, which component is different than the central connecting element. In particular, the central connecting element is provided to be in frictional contact with a surface of the sleeve or bore with a rounded opening in accordance with the Euler-Eytelwein formula and to convert kinetic energy into heat energy in a dissipative manner. In particular, additional damping of movements of the movable platform can be achieved.

Furthermore, it is proposed that the at least one counterforce unit has at least one element with a non-linear force characteristic. An "element with a non-linear force characteristic" is to be understood to mean, in particular, an element which experiences a non-linear extension under tensile stress, for example a rubber cable or a spring element with a non-linear force-extension characteristic curve. In particular, a high variability of the counterforce which is generated by the counterforce unit can be achieved.

The apparatus according to the invention is provided, in particular, to be used with respect to balance training and/or with respect to therapy. In therapy, the apparatus according to the invention can be used, for example, for muscle training. In particular, a use of the apparatus according the invention in cooperation with a games console is proposed. The apparatus according to the invention preferably comprises a control unit which is connected to the games console and can be configured either such that it is integrated into the games console or is separate from the latter. In particular, the control unit which is connected to the games console is formed by the control unit of the setting unit.

Furthermore, a use of the apparatus according to the invention under conditions of reduced gravity for balance training and or fine motor skills training and/or for therapy is proposed. "Conditions of reduced gravity" are to be understood to mean, in particular, conditions, in which a gravitational effect of at most 0.9 g, advantageously at most $1*10^{-3}$ g, preferably at most $1*10^{-6}$ g and particularly preferably at most $1*10^{-8}$ g is active. The gravitational effect can be generated by gravity and/or artificially by way of an acceleration. "g" denotes the value of the gravitational acceleration on Earth of 9.81 $m/s^2$. In particular, a use of the apparatus according to the invention in cooperation with a games console under conditions of reduced gravity is proposed. In particular, a training possibility under conditions of reduced gravity which can be adapted simply to personal requirements can be provided.

In particular, a use of the apparatus according to the invention for a training program can be provided, in which a rapid increase of the counterforce strength by way of an increase of a deflection amplitude of the platform is superimposed on a slow reduction of the counterforce strength of the counterforce unit. In particular, a training program with a high stability which is adapted in a person-specific manner can be achieved.

The apparatus according to the invention is not to be restricted here to the above-described application and embodiment. In particular, the apparatus according to the invention can have a number of individual elements, components and units which differs from a number of said individual elements, components and units mentioned herein with respect to fulfilling a method of operation which is described herein.

DRAWINGS

Further advantages result from the following description of the drawings. The drawings show two exemplary embodiments of the invention. The drawings, the description and the claims contain numerous features in combination. A person skilled in the art will expediently also consider the features individually and combine them to form appropriate further combinations.

Figure 2:
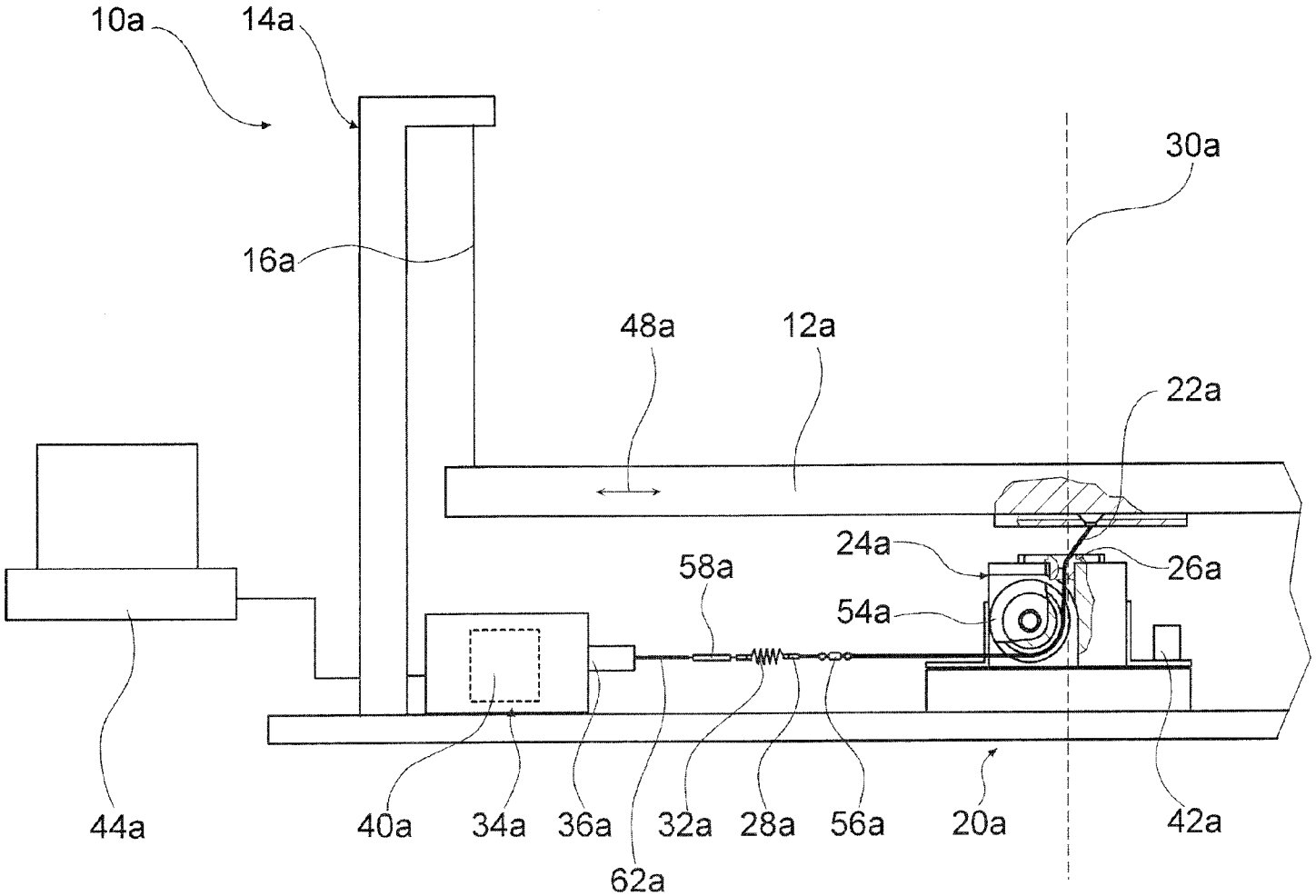
Figure 4:
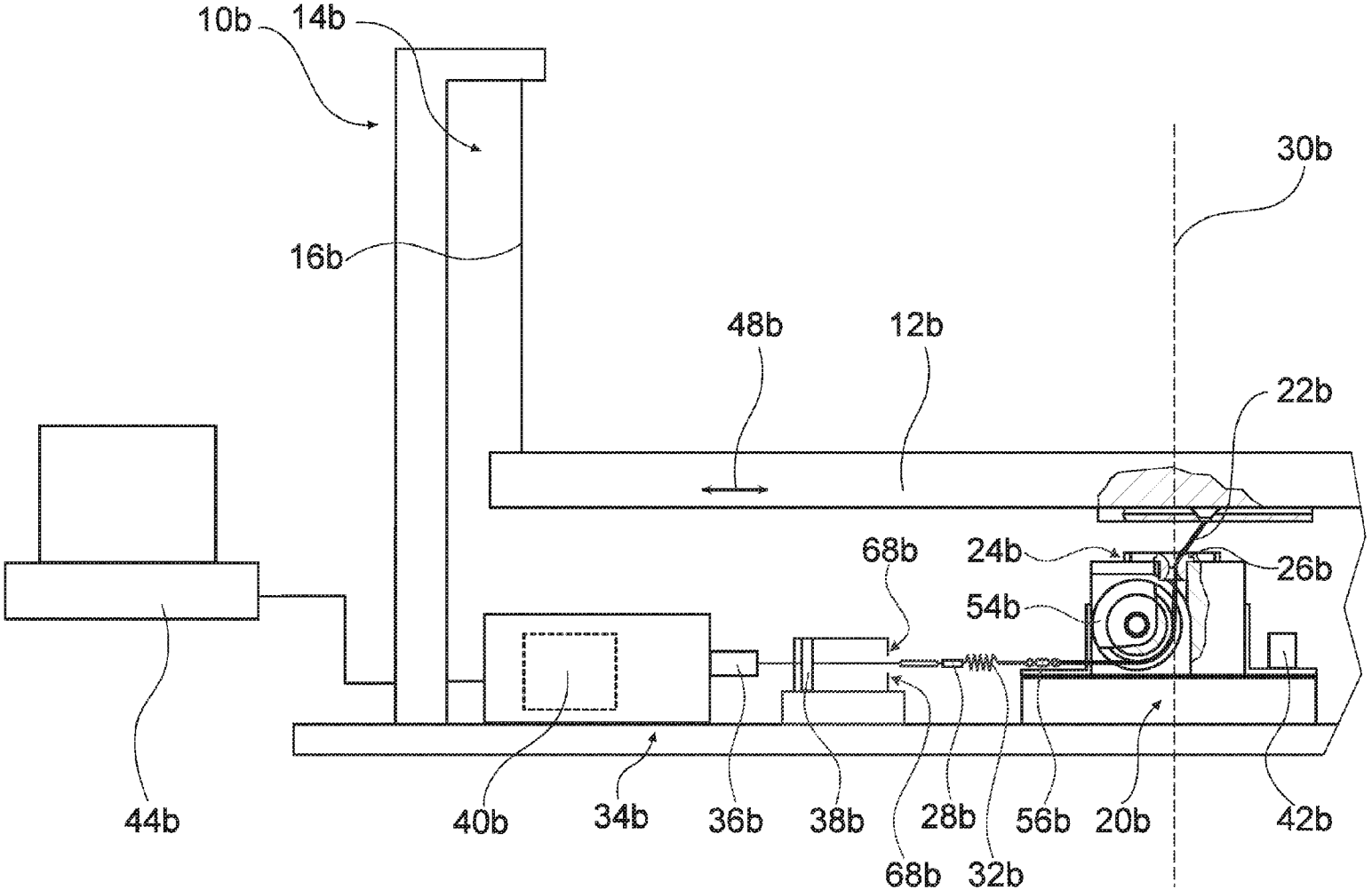

In the Drawings:

FIG. 1 shows a diagrammatic illustration of an apparatus according to the invention in a view obliquely from above, FIG. 2 shows a diagrammatic illustration of a counterforce unit of the apparatus according to the invention with a spring element, an actuator and with a force transmission interruption unit with a connecting element configured as a cable element, FIG. 3 shows diagrammatic illustrations of various modes of operation and associated deflection/counterforce diagrams in section FIGS. 3-A to 3-E, and FIG. 4 shows a diagrammatic illustration of an alternative apparatus with a force transmission interruption unit with a removable piston element.

DESCRIPTION OF THE EXEMPLARY EMBODIMENTS

FIG. 1 shows an apparatus 10*a* according to the invention for balance training having a movable platform 12*a* which can be moved in an oscillating manner in at least two dimensions, having a counterforce unit 20*a* which opposes a force provided for deflection of the movable platform 12*a* by means of a resistance, in a view obliquely from above. The movable platform 12*a* is mounted in a rocking manner by means of suspension elements 16*a*, 18*a* of a suspension unit 14*a* on a frame 52*a* which can be manufactured, for example, from aluminum, the suspension elements 16*a* providing a mounting in one movement direction 48*a* of the movable platform 12*a* and the suspension elements 18*a* providing a mounting in a movement direction 50*a* of the movable platform 12*a*, which movement direction 50*a* is perpendicular with respect to the movement direction 48*a* of the movable platform 12*a*. Here, the suspension elements 16*a*, 18*a* are configured as plastic-encapsulated steel cables which bring about additional damping of the movement via a deformation of a material of a plastic encapsulation. The frame 52*a* has two handles 46*a* which are provided, in particular, as climbing aid. The platform 12*a* can be deflected in two movement directions 48*a*, 50*a* and therefore in two dimensions. In alternative refinements, the platform 12*a* can additionally also be of tiltable configuration. The apparatus 10*a* is provided for use in balance training during a therapy and, furthermore, is provided to be used in cooperation with a games console 44*a*. By way of cooperation with the games console 44*a*, in particular, a simulation of different conditions, for example for training, can be made possible. Use of the apparatus 10*a* can also take place under conditions of reduced gravity, for example on board a space station or a space capsule or on a moon, planet or asteroid, for training measures of astronauts to build up muscles. The movable platform 12*a* of a apparatus 10*a* is deflected by movements of a person standing on a flat surface of the platform 12*a*, it also being possible in alternative refinements for a surface of the platform 12*a* to have a shape which differs from a flat design. Furthermore, in alternative refinements, the movable platform 12*a* can be set in motion by deflection by means of a deflection unit, for example an attached eccentric motor, it being necessary for the person standing on the surface to compensate for the movement caused by the deflection unit in order to achieve a training effect.

The apparatus 10*a* has a counterforce unit 20*a* (FIG. 2). A central connecting element 22*a* which runs at least partially along a zero axis 30*a* of a rest position of the platform 12*a* connects the counterforce unit (60*a*-*b*) and the movable platform (12*a*-*b*) and transmits a counterforce generated by the counterforce unit (60*a-b*) to the purpose of a deflection of the movable platform (12*a-b*). The central connecting element 22*a* is formed by a cable element. The cable element is formed by a steel cable, in alternative design variants, the central connecting element 22*a* can be formed by a cable element made from a different material than steel and can have, for example, a coating, or the central connecting element. 22*a* can be formed at least partially by a chain. The central connecting element 22*a* is connected to the movable platform 12*a* in at a center point of a lower surface of said movable platform 12*a*.

The central connecting element 22*a* transmits the at least two-dimensional movement of the platform 12*a* in a one-dimensional manner to the counterforce unit 20*a*. The counterforce unit 20*a* has a movement conversion unit 24*a* which converts a rotational component of the at least two-dimensional movement of the platform 12*a* into a rotational movement of the central connecting element 22*a* about an axis of its own. The movement conversion unit 24*a* has a bore 26*a* in a body with a rounded opening. In an alternative refinement, instead of a bore 26*a* in a body, the movement conversion unit 24*a* can have a sleeve with a rounded opening. In principle, it is likewise conceivable that the bore 26*a* or the sleeve has a sharp-edged opening. The central connecting element 22*a* is guided through the bore 26*a*, said central connecting element 22*a* bearing against the opening. During a deflection of the platform 12*a* from the rest position, the translational component of the deflection and therefore the movement of the platform 12*a* is converted into a translational movement of the central connecting element 22*a*, whereas a rotational component of the movement is converted into a rotation of a part region of the central connecting element 22*a* between the bore 26*a* and the platform 12*a* about the bore 26*a* of the movement conversion unit 24*a* and, during multiple rotation, about the bore 26*a* into a rotation of the central connecting element 22*a* about the axis of its own. The rotational component of the movement of the platform 12*a* is therefore filtered out and only an amount of the deflection from the rest position remains which is opposed by a resistance by way of the counterforce unit 20*a*. In principle, it is conceivable to provide different resistance strengths for in each case one of the two movement directions 48*a*, 50*a* of the platform 12*a* and, instead of the central connecting element 22*a*, to provide different elements for the connection to separate counterforce elements.

The counterforce unit 20*a* has a spring element 32*a* which is connected to the central connecting element 22*a* and opposes a translational movement of the central connecting element 22*a* by way of a resistance on account of a restoring force, with the result that a deflection of the platform 12*a* is opposed by a resistance via the central connecting element 22*a*. An additional damping element 58*a* of the counterforce unit 20*a* is arranged in series with the spring element 32*a*. The counterforce unit 20*a* has an element with a non-linear force characteristic, which element is formed by the additional damping element 58*a*. The additional damping element 58*a* is configured as a braided rubber cable with a non-linear force characteristic. In alternative refinements of the counterforce unit 20*a*, the additional damping element 58*a* of the counterforce unit 20*a* can be arranged parallel to the spring element 32*a*. Furthermore, the central connecting element. 22*a* is provided for damping of the movement of the platform 12*a* by means of external friction, since the central connecting element 22*a* comes into frictional contact during a translational movement with the surface of the bore 26*a* in accordance with the Euler-Eytelwein formula and, during said external friction, kinetic energy of the central connecting element 22*a* and therefore of the platform 12*a* is dissipated, as a result of which the movement of the platform 12*a* is damped. In particular, the external friction of the central connecting element 22*a* with the surface of the bore 26*a* is provided for damping a reverberation of the platform 12*a* during deflection and for damping movements as a result of a person climbing on. In the exemplary embodiment which is shown, both the central connecting element 22*a* and the surface of the rounded opening of the bore 26*a* are manufactured from steel, but in principle both the central connecting element 22*a* and the surface of the rounded opening of the bore 26*a* can be manufactured from other materials. On a path between the bore 26*a* and the spring element 32*a*, the central connecting element 22*a* is deflected by means of a deflection roller 54*a*. The apparatus 10*a* has an untwisting unit 56*a* which is formed by a turbulence bearing for a connection of the central connecting element 22*a* and the spring element 32*a*, which turbulence bearing makes a rotation of the central connecting element 22*a* about the axis of its own possible, with the result that an action of force on the spring element. 32*a* as a result of the rotation of the connecting element 22*a* about the axis of its own is avoided and the spring element 32*a* is loaded merely with an action of force as a result of the amount of the deflection of the platform 12*a* from the rest position. The untwisting unit 56*a* which is formed by the turbulence bearing is connected via a sleeve element 28*a* to the spring element 32*a*. It conceivable in alternative refinements that, in addition to or instead of the spring element 32*a*, the counterforce unit 20*a* has, for example, an eddy current brake or a friction brake for damping.

A setting unit 34*a* is provided for setting a counterforce strength of the counterforce unit 20*a*. The setting unit 34*a* has an electric actuator 36*a* which sets a prestressing force on the spring element 32*a*. The counterforce strength of the counterforce unit 20*a* is set via a setting of the prestressing force of the spring element 32*a* by way of the actuator 36*a*, since firstly a deflection of the central connecting element 22*a* by the platform 12*a* is opposed by a higher counterforce by way of an increased, prestressing force and secondly a change in a frictional force with the surface of the bore 26*a* in accordance with the Euler-Eytelwein formula is achieved on account of a changed force on the central connecting element 22*a*. The force transmission interruption unit 60*a* comprises a connecting element 62*a* which, in the at least one operating state, in which the force transmission interruption unit 60*a* interrupts the force flow, is mounted at least partially in a stress-relieved state. The connecting element 62*a* is configured as a cable element which, in the stress-relieved state, lies loosely in loops on a floor and is first of all tautened in the case of an action of force on the central connecting element 22*a*. The spring element 32*a* is extended and generates a counterforce only after complete mechanical tautening of the connecting element 62*a* is achieved. Tautening of the connecting element 62*a* takes place in a substantially force-free manner, with the result that no counterforce is exerted on the platform 12*a*. The connecting element 62*a* is arranged between the actuator 36*a* and the spring element 32*a* and can be stressed and relieved by way of the actuator 36*a*, it being possible for the spring element 32*a* to be prestressed by the actuator 36*a* only after complete stressing of the connecting element 62*a*. The setting unit 34*a* has a control unit 40*a* which is integrated into the setting unit 34*a* and which comprises a computing unit and a memory unit with programs which are stored therein. The control unit 40*a* is provided for actuating the actuator 36*a* for adapting the damping. In particular, different counterforce strengths can be set for adapting the apparatus 10*a* to different requirements of users of the apparatus 10*a*, for example to different degrees of balance impairment of different persons who carry out balance training during therapy. A setting of the counterforce strength can take place in an infinitely variable manner on account of the electric actuator 36*a*. In its memory unit, the control unit 40*a* has, in particular, various training programs stored with different degrees of difficulty which are realized via different counterforce strengths, the degree of difficulty changing during the course of the training program being carried out in some training programs. In particular, a setting and adaptation of the counterforce strengths can be carried out during use of the apparatus 10*a* by means of the setting unit 34*a* via the control unit 40*a* and the electric actuator 36*a*, as a result of which it is made possible to realize training programs with different counterforce strengths and therefore degrees of difficulty without an interruption of the training program for adapting the counterforce strength. The control unit 40*a* is provided for carrying out a training program, in which a slow reduction in the counterforce strength of the counterforce unit 20*a* as a result of an increase in a deflection amplitude of the platform 12*a* is superimposed with a rapid increase in the counterforce strength. The rapid increase in the counterforce strengths serves to avoid an excessively large increase in the deflection amplitude of the platform 12*a*, whereas, as a result of the slow reduction in the counterforce strength during the course of the training program as a result of a gradual increase in a deflection amplitude during an identical movement of a person on the platform 12*a*, the person is challenged again and again in the course of the training program and a high training effect is therefore achieved. In particular, the training program comprises an initial phase with a high counterforce strength, in which initial phase movements of the person on the platform 12*a* lead only to a small deflection of the platform 12*a*. After the initial phase, a transition into an actual training phase takes place by way of the slow reduction in the counterforce strength of the counterforce unit 20*a*, in which actual training phase, on account of the reduction of the counterforce strength of the counterforce unit 20*a*, a resulting increase in the deflection amplitude of the platform 12*a* is actuated by way of the control unit 40*a* to produce a rapid increase in the counterforce strength and is superimposed on the slow reduction in the counterforce strength, which results in rapidly changing training conditions, by way of which a high training effect is achieved.

Furthermore, in cooperation with the games console 44*a*, it is possible by means of the control unit 40*a* to simulate different situations for training games on the games console 44*a* by way of different counterforce strengths, for example in order to train astronauts. In alternative refinements, the control unit 40*a* can be integrated into the games console 44*a*, with the result that an actuation of the setting unit 34*a* can take place by way of the games console 44*a*. Furthermore, alternative refinements are conceivable, in which an adaptation of the counterforce strength is performed by hand on the spring element 32*a*. The control unit 40*a* is provided to set the counterforce strength depending on measured values of at least one sensor 42*a* for measuring deflection of the platform 12*a*. The sensor 42*a* is formed by a camera, via which the control unit 40*a* achieves the movement of the platform 12*a* using a detection of markings on an underside of a platform 12*a*. In alternative refinements, the sensor 42*a* can be formed for positional measurements of the platform 12*a* by other sensors 42*a* which appear to be suitable to a person skilled in the art.

FIG. 3-A to FIG. 3-E diagrammatically show different operating modes of the apparatus 10*a* according to the invention. The operating modes are shown in each case by way of a deflection/counterforce diagram and, below it, a diagrammatic setting of the counterforce unit 20*a* and the force transmission interruption unit 60*a*. FIG. 3-A shows an operating mode, in which the force transmission interruption unit 60*a* is set in such a way that the movable platform 12*a* can be deflected substantially free of a counterforce over an entire range of a deflection. Here, the deflection of the platform 12*a* is converted into a tautening section 64*a* of the connecting element 62*a*, which tautening section 64*a* is identified by the letter in the deflection/counterforce diagram. In this operating mode, the force transmission interruption unit 60*a* therefore interrupts a force flow between the platform 12*a* and the counterforce unit 20*a* in every operating state. FIG. 3-B shows an operating mode, in which the force transmission interruption unit 60*a* is set in such a way that the movable platform 12*a* can be deflected substantially free of a counterforce over a part range of a maximum deflection, a deflection being converted into the tautening section 64*a*. In the case of a deflection 64*a* which goes beyond this, the spring element 32*a* is extended by an elongation section 66*a* which is identified by the letter "f" in the deflection/counterforce diagram, and the platform 12*a* experiences a linearly rising counterforce on account of an elongation of the spring element 32*a*. In this operating mode, the force transmission interruption unit 60*a* therefore interrupts a force flow between the platform 12*a* and the counterforce unit 20*a* in operating states, in which the deflection lies in a provided part range of a maximum deflection. In FIG. 3-C, the connecting element 62*a* is already stressed completely in the rest position of the platform 12*a* by way of the actuator 36*a*, and the force transmission interruption unit 60*a* is therefore deactivated. In the case of every deflection in an operating mode of this type, the deflection is converted into an elongation section 66*a* of the spring element 32*a*, and a linearly rising counterforce is generated. In FIG. 3-D, the force transmission interruption unit 60*a* is deactivated and the spring element 32*a* is already prestressed by way of the actuator 36*a*, with the result that a defined counterforce has to be overcome directly to achieve an initial deflection, and the counterforce rises as the deflection increases. In FIG. 3-E, the spring element 32*a* is prestressed to its maximum by way of the actuator 36*a*, with the result that the platform 12*b* cannot be deflected without damaging the apparatus 10*b*, a force which is necessary for this purpose being selected by way of a suitable selection of the spring element 36*a* in such a way that said force is not achieved as a result of regular operation. If an element with a nonlinear force characteristic is used in the counterforce unit 20*a*, the diagrams which are shown change to the extent that a linearly growing counterforce profile is replaced with a nonlinearly growing counterforce profile.

FIG. 4 shows a further exemplary embodiment of the invention. The following descriptions and the drawing are restricted substantially to the differences between the exemplary embodiments, it being possible in principle for reference also to be made to the drawings and/or the description of the other exemplary embodiments, in particular of FIGS. 1 to 3, with regard to components with identical designations, in particular in relation to components with identical reference numerals. In order to distinguish the exemplary embodiments, the letter a is placed behind the reference numerals of the exemplary embodiment in FIGS. 1 to 3. The letter a is replaced by the letter b in the exemplary embodiments of FIG. 4. An alternative apparatus 10*b* for balance training with a movable platform 12*b* which can be moved in an oscillating manner in at least two dimensions, with a counterforce unit 20*b* which opposes a force provided for deflection of the movable platform. 12*h* with a resistance, and with a force transmission interruption unit 60*b* which interrupts a force flow between the movable platform 12*b* and the counterforce unit 20*b* in at least one operating state, is configured substantially analogously with respect to the preceding exemplary embodiment (FIG. 4). The force transmission interruption unit 60*b* of the apparatus 10*b* comprises a piston element 38*b* in a piston container, which piston element 38*b* can be displaced in the piston container by way of an electric actuator 36*b* of a setting unit 34*h*. The piston element 38*b* can be connected to a central connecting element 22*h* and can be pulled by the latter out of the piston container until a stop 68*b* is reached. A spring element 32*b* is arranged behind the piston element 36*b* as viewed from the direction of the central connecting element 22*b*. An extension of the piston element 38*b* takes place in a substantially force-free manner, with the result that, by way of a deflection of the movable platform 12*b* as a result of movements of a person standing on the movable platform 12*b*, first of all the piston element 36*b* is extended and a force flow to the counterforce unit 20*b* is interrupted, as a result of which the deflection takes place without counterforce. As soon as the piston element 38*b* is completely extended, the piston element 38*b* and the piston container are driven by the central connecting element 22*b* as a result of a further deflection of the platform 12*b*, to which end the piston holder and the piston element 38*b* are mounted displaceably and are secured, by way of a securing apparatus which can be overcome by a predefined force, against displacement before complete extension of the piston element 38*h*, and the spring element 32*b* is subsequently extended, which spring element 32*h* opposes said extension with a restoring force on account of an elasticity, as a result of which a counterforce is generated which grows linearly with the deflection.

LIST OF REFERENCE NUMERALS

10 Apparatus
12 Platform
14 Suspension unit
16 Suspension element
18 Suspension element
20 Counterforce unit
22 Connecting element
24 Movement conversion unit
26 Bore
28 Sleeve element
30 Zero axis
32 Spring element
34 Setting unit
36 Actuator
38 Piston element
40 Control unit
42 Sensor
44 Games console
46 Handle
48 Movement direction
50 Movement direction
52 Frame
54 Deflection roller
56 Untwisting unit
58 Additional damping element
60 Force transmission interruption unit
62 Connecting element
64 Tautening section
66 Elongation section

The invention claimed is:

1. An apparatus, for balance training and/or fine motor skills training, comprising:

at least one movable platform which is configured to be moved in an oscillating manner in at least two dimensions, and which has a standing surface configured for a person to stand on and deflect the at least one movable platform on account of his/her own movements and/or counteract a deflection of the at least one movable platform;

at least one counterforce unit which is provided to oppose a force provided for deflection of the at least one movable platform with a resistance;

at least one force transmission interruption unit which interrupts a force flow between the at least one movable platform and the at least one counterforce unit in at least one operating state, the at least one force transmission interruption unit comprising a connecting element connected to the at least one counterforce unit, which in the at least one operating state is mounted in a stress-relieved state, wherein:

in the at least one operating state, the deflection of the at least one movable platform from a rest position takes place substantially free of a counterforce by the at least one counterforce unit, and the connecting element, which is mounted in the stress-relieved state, is first tautened by way of the deflection of the at least one movable platform, and the force flow is guided to the counterforce unit only after complete tautening, whereupon the deflection of the at least one movable platform is opposed by the counterforce by the at least one counterforce unit; and the apparatus further comprises at least one setting unit which is provided for setting a counterforce strength to the at least one movable platform, wherein the at least one setting unit has a control unit, which is provided to set the counterforce strength, and thereby deflection amplitude of the at least one movable platform, depending on measured values of at least one sensor for measuring the deflection of the at least one movable platform, deflection speed of the at least one movable platform, or deflection acceleration of the at least one movable platform.

2. The apparatus according to claim 1, further comprising:

at least one central connecting element which runs at least partially along a zero axis of the rest position of the at least one movable platform, connects the at least one counterforce unit and the at least one movable platform, and is provided to transmit the counterforce which is generated by the at least one counterforce unit to deflect the at least one movable platform.

3. The apparatus according to claim 2, wherein the at least one central connecting element transmits the at least two-dimensional movement of the at least one movable platform to the counterforce unit in a one-dimensional manner.

4. The apparatus according to claim 3, wherein the at least one counterforce unit has at least one movement conversion unit which converts a rotational component of the at least two-dimensional movement of the at least one movable platform into a rotational movement of the at least one central connecting element about an axis of the at least one movement conversion unit.

5. The apparatus according to claim 4, wherein the movement conversion unit has at least one sleeve or one bore with a rounded opening.

6. The apparatus according to claim 2, wherein the at least one central connecting element is provided for damping the movement of the at least one movable platform by means of external friction.

7. The apparatus according to claim 1, wherein the at least one control unit is provided for executing a training program.

8. The apparatus according to claim 7, wherein the training program comprises an initial phase with a high counterforce strength, in which initial phase movements of the person on the at least one movable platform lead only to a small deflection of the at least one movable platform, and wherein after the initial phase a transition into an actual training phase takes place by way of a slow reduction in the counterforce strength of the counterforce unit.

9. The apparatus according to claim 8, wherein the control unit, in the actual training phase, on account of the reduction of the counterforce strength of the counterforce unit, is provided to actuate a resulting increase in the deflection amplitude of the at least one movable platform to produce a rapid increase in the counterforce strength, which is superimposed on the slow reduction in the counterforce strength.

10. The apparatus according to claim 7, wherein stability and motor capabilities of the person who passes through the training program are determined and trained by way of a slow reduction of the counterforce strength and an increase, associated therewith, of the deflection of the at least one movable platform, which deflection is brought about by movements of the person.

11. The apparatus according to claim 7, wherein the control unit is provided for executing the training program, in which a slow reduction in the counterforce strength of the counterforce unit as a result of an increase in the deflection amplitude of the at least one movable platform is superimposed with a rapid increase in the counterforce strength.

12. The apparatus according to claim 1, wherein the at least one setting unit has at least one actuator.

13. The apparatus according to claim 12, wherein the at least one actuator is an electric actuator.

14. The apparatus according to claim 1, wherein the connecting element of the at least one force transmission interruption unit is at least one connecting element which, in the at least one operating state, is mounted in the stress-relieved state.

15. The apparatus according to claim 1, wherein the at least one counterforce unit has at least one spring element.

16. The apparatus according to claim 1, wherein the at least one counterforce unit has at least one element with a non-linear force characteristic.

17. The apparatus according to claim 1, wherein the connecting element of the force transmission interruption unit comprises a cable element, and the force transmission interruption unit interrupts the force flow between the at least one movable platform and the counterforce unit by stressing the cable element, which was previously held slack in the stress-relieved state.

18. The apparatus according to claim 1, wherein the counterforce of the at least one counterforce unit rises as the deflection of the at least one movable platform increases.

19. A method of using an apparatus according to claim 1 for balance training and/or fine motor skills training, comprising:

standing, by the person, on the standing surface of the at least one movable platform which is configured to be moved in an oscillating manner in at least two dimensions, the person deflecting the at least one movable platform on account of his/her own movements and/or counteracting the deflection of the at least one movable platform;

opposing the force provided for the deflection of the at least one movable platform with the resistance by the at least one counterforce unit; and interrupting, by the at least one force transmission interruption unit, the force flow between the at least one movable platform and the at least one counterforce unit in the at least one operating state in which the deflection of the at least one movable platform from the rest position takes place substantially free of the counterforce by the at least one counterforce unit, wherein the connecting element, which is mounted in the stress-relieved state, is first of all tautened by way of the deflection of the at least one movable platform, and the force flow is guided to the counterforce unit only after complete tautening, whereupon the deflection of the at least one movable platform is opposed by the counterforce by the at least one counterforce unit; and setting the counterforce strength, and thereby the deflection amplitude of the at least one movable platform, depending on measured values of the at least one sensor for measuring the deflection of the at least one movable platform, the deflection speed of the at least one movable platform, or the deflection acceleration of the at least one movable platform, by the at least one setting unit, wherein the control unit of the at least one setting unit is provided to set the counterforce strength to the at least one movable platform.

20. The method according to claim 19, wherein the standing, the opposing, and the interrupting are performed under conditions of reduced gravity in cooperation with a games console.

* * * * *